US005250002A

United States Patent [19]

Kinberg

[11] Patent Number: 5,250,002

[45] Date of Patent: Oct. 5, 1993

[54] INFLATABLE PLAY GYM

[76] Inventor: Benjamin Kinberg, 425 Riverside Dr., Apt. 5A, New York, N.Y. 10025

[21] Appl. No.: 726,345

[22] Filed: Jul. 5, 1991

[51] Int. Cl.[5] ..... A63H 33/00

[52] U.S. Cl. ..... 446/220; 446/227

[58] Field of Search ..... 446/227, 220, 236, 419, 446/265, 221, 222, 223, 224, 225, 226; 248/163.1, 163.2

[56] References Cited

U.S. PATENT DOCUMENTS

| | | | |
|---|---|---|---|
| 1,318,024 | 10/1919 | Sundell | 446/227 |
| 2,927,383 | 3/1960 | Longino | 446/221 X |
| 3,008,265 | 11/1961 | Converse | 446/265 X |
| 3,559,332 | 2/1971 | Stephens | 446/226 |
| 4,232,477 | 11/1980 | Lin | 446/220 X |
| 4,391,064 | 7/1983 | Lakin et al. | 446/227 |
| 5,076,520 | 12/1991 | Bro | 446/227 X |
| 5,088,952 | 2/1992 | Goldblatt | 446/220 |

FOREIGN PATENT DOCUMENTS

| | | | |
|---|---|---|---|
| 149296 | 7/1985 | European Pat. Off. | 446/227 |
| 1250880 | 12/1960 | France | 446/220 |

*Primary Examiner*—Mickey Yu

*Attorney, Agent, or Firm*—Grimes & Battersby

[57] ABSTRACT

An infant's inflatable play gym for use either as a crib toy or floor toy which includes a pair of opposed upright end supports for rotatably supporting therebetween an inflatable chamber. Within the inflatable chamber are a plurality of loosely disposed amusing playthings which are free to tumble within the inflatable chamber as the chamber is rotated. To impart a tumbling motion to the playthings within the inflatable chamber are a plurality of transversely extending vanes which are radially and circumferentially spaced therein. The chamber is also provided with a valve through which air may be pumped to inflate or to exhaust to deflate the chamber.

12 Claims, 3 Drawing Sheets

FIG. 2
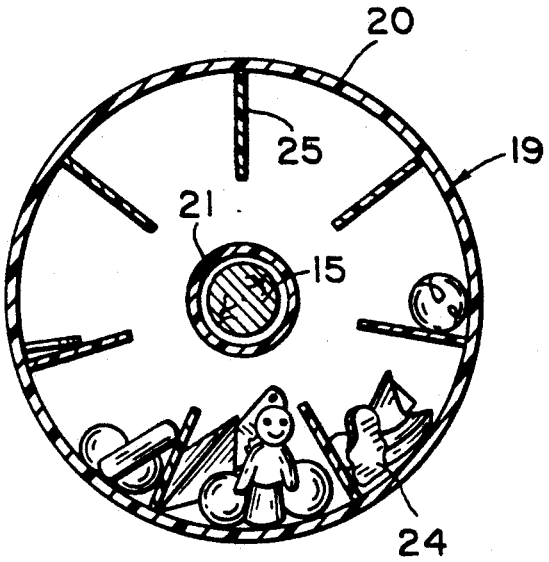
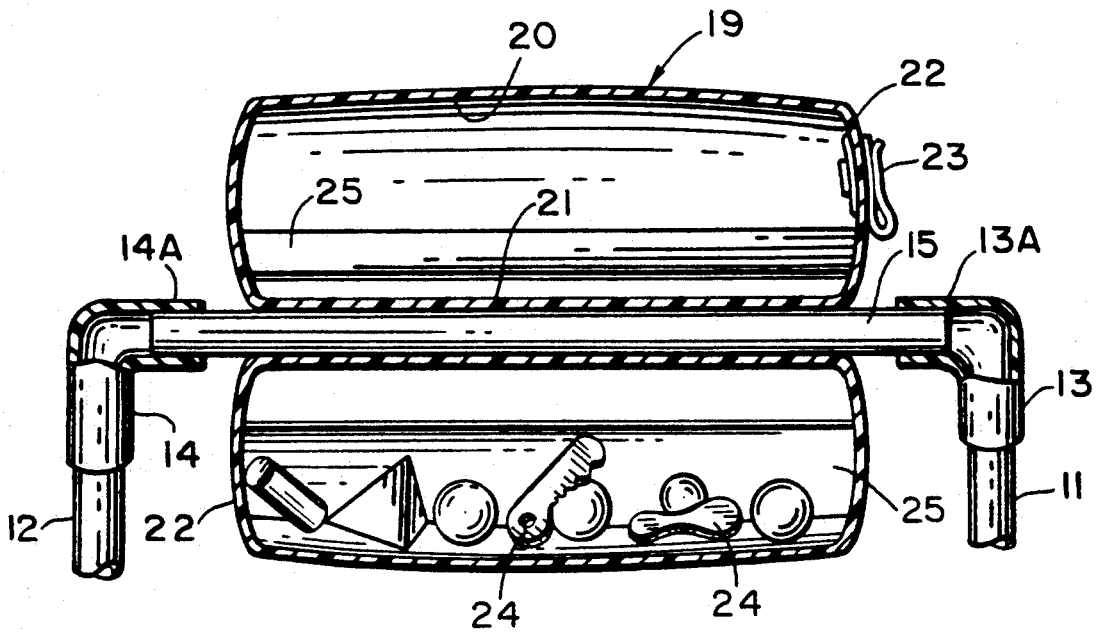
FIG. 3

FIG. 4
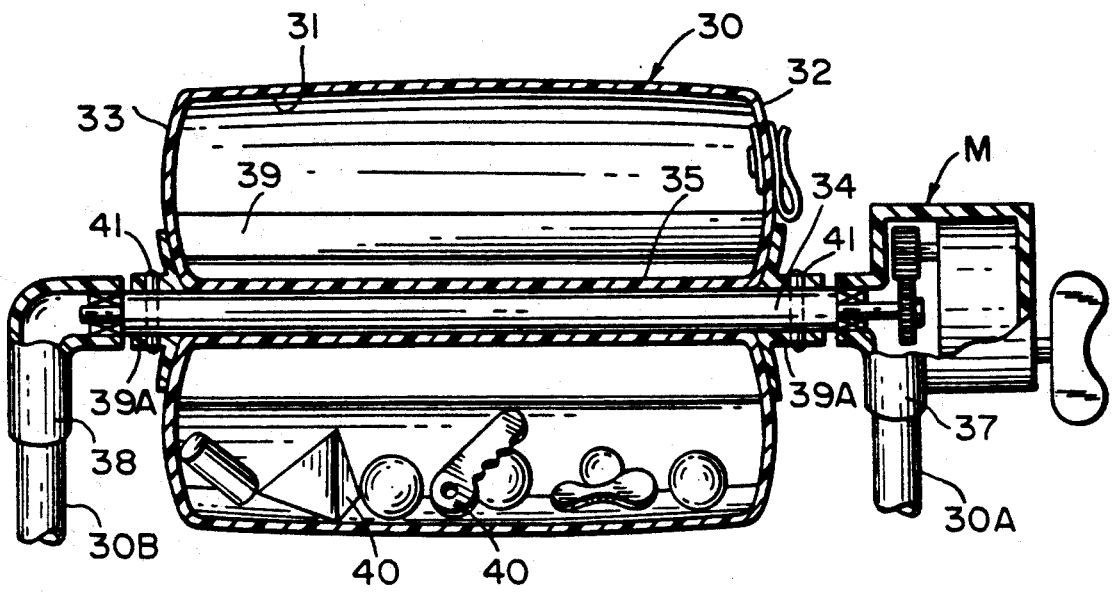
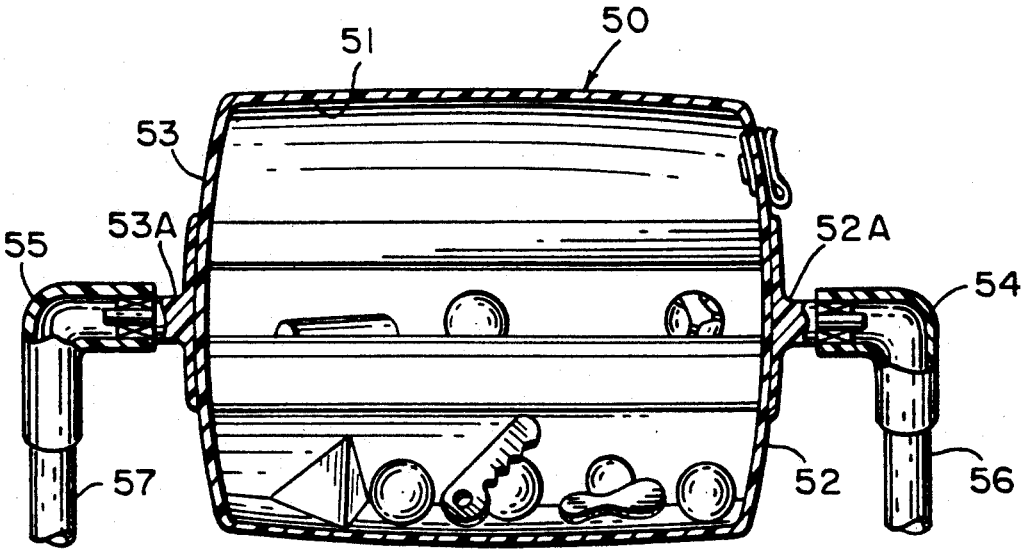
FIG. 5

INFLATABLE PLAY GYM

This invention is related to a child's play gym and more specifically to an infant's play gym which can be readily used as a crib attraction or a floor attraction for infants of three months to one year or more.

DESCRIPTION OF THE PRIOR ART

Heretofore, children's play gyms are well known. Generally, such play gyms comprise full scale swing sets formed by a pair of end supports for supporting therebetween a cross bar from which one or more swing sets are supported and on which children of various ages can play. Toy swing sets or play gyms are also known. One such small child's toy play gym comprises a pair of opposed end supports having connected therebetween a cross bar. Various amusing play things in the form of loops, dolls and other amusing toy items are dependently suspended from the cross bar with which a small child can amuse itself. Such toy gym sets were usually made of rigid plastic tubing or the like. These known toy play gyms provided limited amusement to a child and not particularly of interest to an infant who is too young to crawl or walk.

OBJECTS OF THE PRESENT INVENTION

An object of this invention is to provide an infant's toy gym set which can be utilized either as a crib toy or floor toy that is particularly amusing to an infant.

Another object is to provide an infant's toy gym set which is relatively simple in construction, inexpensive to fabricate and which is positive in operation.

Another object is to provide an infant's toy gym set having an action feature which is pleasing and amusing to an infant.

Another object is to provide an infant's toy gym set having an inflatable chamber formed as an integral part thereof which can be readily inflated and deflated, which when inflated, enhances the play value of the toy gym set and when deflated provides ease of shipment and/or storage when not in use.

SUMMARY OF THE INVENTION

The foregoing objects are attained by an infant's toy gym set which comprises a pair of opposed upright end supports for supporting therebetween an inflatable chamber which is rotatably mounted between the end supports. The chamber is provided with a suitable valve for inflating and deflating the chamber. Disposed within the chamber are a plurality of various playthings that are free to tumble within the chamber when the chamber is rotated. To enhance the tumbling effect of the playthings within the chamber, there is provided a plurality of transversely extending vanes circumferentially spaced within the chamber. In one form of the invention, the chamber is formed integral to a cross bar which is rotatably supported between the end supports. In another form of the invention, the chamber is formed with a center sleeve through which the cross bar extends. In another embodiment, the inflatable chamber is provided with opposed side trunnions which are rotatably supported to the end supports. Each of the end supports includes a pair of leg members which are secured at their upper ends by a V fitting having a lateral offset socket for supporting the chamber.

BRIEF DESCRIPTION OF THE DRAWINGS

A feature of the invention resides in providing a toy play gym with an inflatable chamber rotatably supported between the end supports and having disposed therein a plurality of playthings which are free to tumble therein and which are rendered appealing to infants.

Another feature resides in the provision of a plurality of vanes circumferentially spaced within the inflatable chamber to enhance the tumbling effect of the playthings disposed therein.

Figure 1:
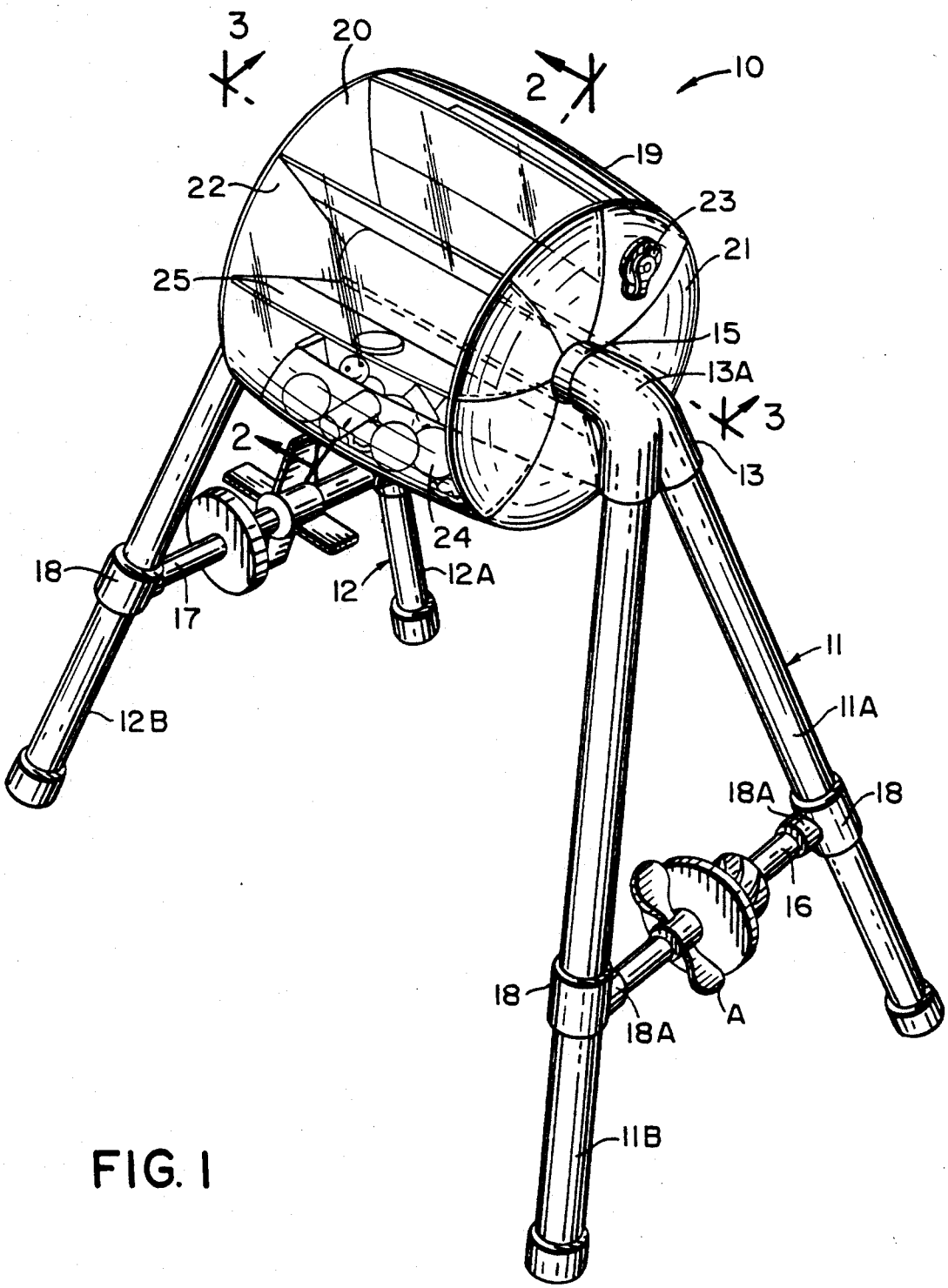

Other features and advantages will become more readily apparent when considered in view of the drawings and specifications in which:

FIG. 1 is a perspective view of an infant's play gym set embodying the invention.

FIG. 2 is a sectional view taken along line 2—2 on FIG. 1.

FIG. 3 is a sectional view taken along line 3—3 on FIG. 1.

FIG. 4 is an elevational view of a modified form of the invention having parts shown in section.

FIG. 5 is a perspective view of another modified form of the invention.

DETAIL DESCRIPTION OF THE PREFERRED EMBODIMENTS

Referring to the drawings and in particular to FIGS. 1 to 3, there is illustrated an infant's toy gym set embodying the present invention. Infant, as used herein, is defined as a child ranging between three months to one year of age. As shown, the toy gym set 10 of FIG. 1 comprises a pair of opposed upright supports 11 and 12. Each upright support 11 and 12 includes a pair of leg members 11A, 11B and 12A, 12B which are arranged to converge toward the upper ends thereof. The upper ends of the respective leg members 11A, 11B and 12A, 12B are connected by a fitting 13 and 14 respectively. As seen, the fittings 13 and 14 comprise a generally V-shape fitting having a pair of sockets for slid ably receiving the upper ends of the corresponding leg members. The arrangement is such that the leg members are frictionally received within the corresponding sockets of the respective fitting. Each fitting 13 and 14 is also provided with a laterally off-set socket 13A and 14A respectively which provides the end support for a cross bar 15; which is preferably round in cross-section. To stabilize the end supports 11 and 12, a tie bar 16 and 17 is interconnected between the respective pair of leg members 11A, 11B and 12A, 12B. This is readily attained by a T-shape fitting 18 which is slipped onto the respective legs whereby the cross arm of the fitting 18 slides onto the respective leg whereby the cross arm of the fitting 18 slides onto the respective leg with the tie bar fitted between the opposed stem 18A portion of the T fitting 18. Rotatably and slidably mounted on the respective tie bars 16 and 17 are a plurality of beads, propellers and other amusing articles A which can be readily manipulated by an infant or its parents for imparting additional play value or activity to the toy 10.

In accordance with this invention, an inflatable means or chamber 19 is rotatably mounted on the cross bar 15. In the illustrated form of the invention, the inflatable chamber 19 is defined by a cylindrical outer shell 20 formed of a suitable plastic material. Disposed axially of the shell 20 is a center sleeve 21 for receiving the cross bar 15 about which the chamber 19 is free to rotate. Opposed end walls 22, 22 are secured between the outer shell 20 and sleeve 21 to define an air tight chamber 19. A suitable valve 23 is provided to allow for inflating and/or deflating the chamber 19.

Disposed within the chamber 19 and free to tumble therein as the chamber 19 is rotated are a plurality of individual playthings or beads. It will be understood that the playthings 24 may simulate any figure or shape that may appeal to an infant. To facilitate the tumbling of the playthings within the chamber when rotated, the chamber is provided with a plurality of circumferentially spaced internal vanes 25 which are radially disposed therein. Thus, it will be apparent that as the chamber is rotated about the cross bar 15, the internal vanes will cause the playthings to be caught thereby and released when the vanes reach the zenith of its rotation. The rotating chamber thus presents an amusing and appealing attraction to an infant as the playthings 24 disposed therein rise and fall upon the continued rotation of the chamber. The tumbling of the playthings within the chamber also produces a random sound which also supplements the visual appeal. If desired, the outer shell may be suitably decorated in colors which may also impart thereto a kaleidoscope effect.

Within the construction described, it will be apparent that the toy gym set 10 may be mounted above a crib and utilized as a crib toy or it can stand on a floor and be utilized as a floor toy. In either event, the infant lying below the inflatable chamber can be readily amused by the action, sound and sight of the rotating chamber and the tumbling playthings disposed therein.

FIG. 4 illustrates a modified form of the invention. In this form of the invention, the end supports 30A, 30B are constructed as hereinbefore described. In this form of the invention, the inflatable chamber 30 comprises an outer shell 31 which is cylindrical in shape and sealed at the ends by end walls 32 and 33. As shown in FIG. 4, the cross bar 34 is projected through the sleeve 35 extending between side walls 32, 33 and sealed thereat to define an annular chamber 31, which is supported on the cross bar 35. The cross bar in turn is rotatably journalled in the support fittings 37 and 38. As hereinbefore described, the inflatable chamber includes the internal vanes 39 and internally disposed playthings 40. In this form of the invention, rotation of the inflatable chamber 30 is effected by rotation of the cross bar 35 to which the inflatable chamber is fixed, e.g. pins 41 extending to mounting sleeves 39A connected to the end walls 32, 33 of the inflatable chamber. If desired, a motor means M may be connected in driving relationship to the cross bar 35 as shown to effect rotation of the chamber 30 connected to the cross bar 35. In the illustration embodiment, the motor M comprises a spring wound motor which is suitably geared to one end of the cross bar as shown to effect rotation thereof. A small electrical motor may be substituted in lieu thereof. In all other respects, the embodiment of FIG. 4 is similar to that of FIGS. 1 to 3.

FIG. 5 illustrates a further embodiment of the invention. This form of the invention differs from that hereinbefore described in that the inflatable chamber 50 comprises an outer shell 51 which is sealed by end walls 52 and 53. Connected to the respective end walls 52 and 53 is an outwardly projecting trunnion or axle 52A, 53A respectively. The outer ends of the trunnions 52A, 53A are rotatably supported in the end fittings 54, 55 respectively of the end supports 56, 57. In all other respects, the toy gym set is similar to that hereinbefore described with respect to FIG. 1

While the embodiments herein described are constructed so as to permit the inflatable chambers 19 and 50 to be manually rotated, it will be understood that if desired, the inflatable chamber could be motorized by a small mechanical or electrical motor as shown in FIG. 4, which can be suitably geared to effect rotation of the chamber when the motor is activated. Also, it will be understood that a music box can be suitably associated with the rotating chamber which is actuated when the chamber is rotated.

Although the preferred embodiment has been illustrated and described, it will be obvious to those skilled in the art that various modifications may be made without departing from the spirit and scope of this invention.

What is claimed is:

1. An inflatable play gym comprising:

a pair of spaced apart end supports;

a cross bar interconnected between said pair of end supports;

an inflatable chamber connected to said cross bar and rotatable therewith between said pair of end supports, said inflatable chamber having a plurality of circumstantially spaced vanes disposed therein; and at least one plaything disposed within said inflatable chamber, said at least one plaything being loosely retained within said inflatable chamber, whereby said at least one plaything is freely movable within said inflatable chamber and is adapted to be captured and released by said plurality of vanes as said inflatable chamber is rotated between said pair of end supports.

2. An inflatable play gym as defined in claim 1, wherein said at least one plaything includes a plurality of playthings.

3. An inflatable play gym as defined in claim 1, wherein said vanes extend transversely of said inflatable chamber.

4. An inflatable play gym as defined in claim 1, further comprising valve means that provides an inlet and an outlet for inflating and deflating said inflatable chamber.

5. An inflatable play gym as defined in claim 1, wherein said inflatable chamber comprises a cylindrical outer shell and opposed end walls, said outer shell being connected to and between said opposed end walls.

6. An inflatable play gym comprising:

a pair of spaced apart end supports;

a cross bar interconnected between said pair of end supports, said cross bar being mounted on said pair of end supports;

an inflatable chamber connected to said cross bar in sealing relationship therewith, whereby said inflatable chamber is free to rotate therewith, said inflatable chamber having a plurality of circumstantially spaced vanes disposed therein; and at least one plaything disposed within said inflatable chamber, said at least one plaything being free to tumble within said inflatable chamber and be captured and released by said plurality of vanes during rotation of said inflatable chamber.

7. An inflatable play gym comprising:

a pair of spaced apart upright end supports each having an upper end, a cross bar interconnected between the upper ends of said pair of upright end supports;

an inflatable means rotatably journalled about said cross bar; and at least one plaything disposed within said inflatable means whereby said plaything is free to tumble within said inflatable means as said inflatable means rotates about said cross bar.

8. An inflatable play gym as defined in claim 7, wherein said inflatable means comprises an air tight chamber, said air tight chamber including:

an outer cylindrical shell;

a center sleeve having a diameter slightly greater than the diameter of said cross bar;

a pair of annular end walls interconnected to said outer shell and said center sleeve;

said cross bar extending transversely through said center sleeve; and valve means for inflating and deflating said air tight chamber.

9. An inflatable play gym as defined in claim 8, further comprising a plurality of circumferentially spaced vanes extending transversely between said pair of annular end walls for randomly tumbling said at least one plaything within said chamber as said chamber is rotated relative to said cross bar.

10. An inflatable play gym as defined in claim 7, wherein said pair of upright end supports each includes a pair of upwardly extending leg members, said leg members converging toward one another at the upper ends thereof, a connector for receiving and securing the upper ends of said leg members together, said connector including an angularly disposed socket for receiving and supporting an end portion of said cross bar to said pair of upright end supports, and a tie rod interconnected between said leg member intermediate the ends thereof, and a rotatably journalled plaything mounted on said tie rod.

11. An inflatable infant play gym comprising:

a pair of spaced apart end supports;

a cross bar interconnected between said pair of end supports;

an inflatable means having a center sleeve through which said cross bar extends and about which said inflatable means is adapted to rotate, said inflatable means including a cylindrical outer shell having a pair of opposed ends;

an end wall connected to each opposed end of said cylindrical shell;

at least one plaything loosely disposed within said cylindrical shell; and a plurality of vanes disposed within said cylindrical shell to impart a tumbling effect to said plaything disposed within said cylindrical shell during rotation of said cylindrical shell.

12. An inflatable play gym as defined in claim 6, wherein said at least one plaything includes a plurality of playthings.

* * * * *